US010147406B1

(12) United States Patent
Blekherman et al.

(10) Patent No.: US 10,147,406 B1
(45) Date of Patent: Dec. 4, 2018

(54) MUSICAL INSTRUMENT STRAP

(71) Applicants: Yevgeniy Blekherman, Brooklyn, NY (US); Dimitri Vishnepolsky, Brooklyn, NY (US)

(72) Inventors: Yevgeniy Blekherman, Brooklyn, NY (US); Dimitri Vishnepolsky, Brooklyn, NY (US)

( * ) Notice: Subject to any disclaimer, the term of this patent is extended or adjusted under 35 U.S.C. 154(b) by 0 days.

(21) Appl. No.: 15/875,736

(22) Filed: Jan. 19, 2018

(51) Int. Cl.
*G10G 5/00* (2006.01)
*G10D 3/16* (2006.01)

(52) U.S. Cl.
CPC ..... *G10G 5/005* (2013.01); *G10D 3/163* (2013.01)

(58) Field of Classification Search
CPC ..... G10G 5/005; G10D 3/163
See application file for complete search history.

(56) References Cited

U.S. PATENT DOCUMENTS 7,205,467 B2 * 4/2007 Tafolla ..... G10G 5/005 84/327

* cited by examiner

*Primary Examiner* — Kimberly Lockett
(74) *Attorney, Agent, or Firm* — Lawrence G. Fridman, Esq.; Feifin & Fridman, LLC

(57) ABSTRACT

A strap attachable to a musical instrument for enabling a musician to wear the musical instrument and for carrying at least one instrument playing accessory.

19 Claims, 4 Drawing Sheets

MUSICAL INSTRUMENT STRAP

FIELD AND BACKGROUND OF THE DISCLOSED TECHNOLOGY

The disclosed technology relates generally to straps for wearing musical instruments while playing the instrument, and, more specifically, to a strap for holding a musical instrument which can have attached thereto instrument playing accessories, thereby enabling the musician easier access to the instrument playing accessories.

U.S. Pat. No. 6,202,262 discloses a quick disconnect coupling for adapting a guitar strap having a pair of ends with throughbores to a guitar having a pair of guitar strap-attaching pegs that engage the throughbores in the pair of ends of the guitar strap of the guitar, respectively. One of the main drawbacks of this patent is that it provides practically no accommodation for the instrument playing accessories.

SUMMARY OF THE DISCLOSED TECHNOLOGY

The disclosed technology relates generally to straps for wearing musical instruments while playing the instrument, and, more specifically, to a strap for holding a musical instrument which can have attached thereto instrument playing accessories, thereby enabling the musician easier access to the instrument playing accessories.

According to an embodiment of the teachings herein, there is provided a strap attachable to a musical instrument for enabling a musician to wear the musical instrument and for carrying at least one instrument playing accessory, the strap including:

an elongate main body portion, adapted to be placed on the body of the musician, the main body portion including an exterior surface adapted to be visible when the strap is worn by the musician, the at least one exterior layer including at least one attachment mechanism, for reversible attachment of the at least one instrument playing accessory, and at least one illumination element;

a pair of end elements, each disposed on one end of the main body portion, and including at least one instrument attachment mechanism for attaching the strap to the musical instrument; and at least one length adjustment mechanism, disposed between an end of the main body portion and one of the end elements, adapted to adjust a length of the strap.

In some embodiments, the elongate main body portion includes:

a body engaging layer adapted to engage the body of the musician when the strap is placed on the body of the musician;

an exterior layer including the exterior surface; and a padding layer disposed between the body engaging layer and the exterior layer.

In some embodiments, the body engaging layer includes of a breathable material, the exterior layer includes a synthetic fabric, and the padding layer includes foam or foam rubber.

In some embodiments, the strap is formed of at least one of leather, synthetic fabric, and silicone.

In some embodiments, the at least one illumination element includes an illumination generating element. In some embodiments, the at least one illumination element includes an illumination reflecting element.

In some embodiments, the strap further includes at least one receptacle adapted to house an additional instrument playing accessory.

In some embodiments, the at least one attachment mechanism includes at least one of a hook portion of a Velcro strip, a loop portion of a Velcro strip, at least one fastener, and at least one magnetic element.

According to another embodiment of the teachings herein, there is provided a system for carrying a musical instrument, the system including:

a strap, reversibly attachable to the musical instrument, the strap including:

an elongate main body portion, adapted to be placed on the body of the musician, the main body portion including an exterior surface adapted to be visible when the musical instrument is worn by the musician, the at least one exterior layer including at least one attachment mechanism and at least one illumination element;

a pair of end elements, each disposed on one end of the main body portion, and including at least one instrument attachment mechanism for reversibly attaching the strap to the musical instrument; and at least one length adjustment mechanism, disposed between an end of the main body portion and one of the end elements, adapted to adjust a length of the strap; and at least one instrument playing accessory associated with at least one corresponding attachment mechanism, reversibly attachable to the at least one attachment mechanism, thereby to reversibly attach the at least one instrument playing accessory to the strap.

In some embodiments, the at least one corresponding attachment mechanism is disposed on at least one receptacle for the at least one instrument playing accessory, the at least one receptacle being reversibly attachable to the at least one attachment mechanism.

In some embodiments, the musical instrument includes a guitar, and the at least one instrument playing accessory includes at least one of a capo, a slide, a guitar pick holder, a guitar pick, and a flask.

In some embodiments, the elongate main body portion of the strap includes:

a body engaging layer adapted to engage the body of the musician when the strap is placed on the body of the musician;

an exterior layer including the exterior surface; and a padding layer disposed between the body engaging layer and the exterior layer.

In some embodiments, the body engaging layer includes of a breathable material, the exterior layer includes a synthetic fabric, and the padding layer includes foam or foam rubber.

In some embodiments, the strap is formed of at least one of leather, synthetic fabric, and silicone.

In some embodiments, the at least one illumination element includes an illumination generating element. In some embodiments, the at least one illumination element includes an illumination reflecting element.

In some embodiments, the system further includes at least one receptacle adapted to house an additional instrument playing accessory. In some embodiments, the additional instrument playing accessory includes a flashlight.

In some embodiments, at least one of the following:

the at least one attachment mechanism includes a hook portion of a Velcro strip and the at least one corresponding attachment mechanism includes a loop portion of a Velcro strip;

the at least one attachment mechanism includes a loop portion of a Velcro strip and the at least one corresponding attachment mechanism includes a hook portion of a Velcro strip;

the at least one attachment mechanism includes at least one fastener and the at least one corresponding attachment mechanism includes a corresponding fastener; and the at least one attachment mechanism includes at least one magnetic element and the at least one corresponding attachment mechanism includes a corresponding magnetic or metallic element.

DETAILED DESCRIPTION OF EMBODIMENTS OF THE DISCLOSED TECHNOLOGY

Figure 1:
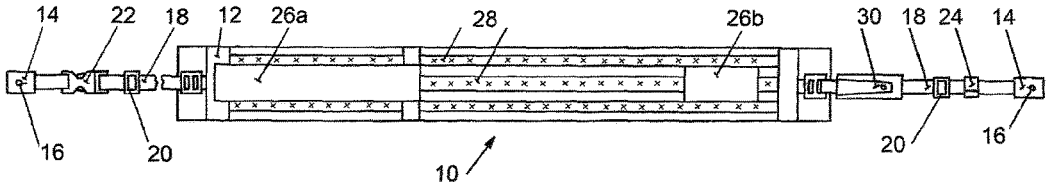
FIG. 1 is a top view planar illustration of a strap for a musical instrument according to an embodiment of the disclosed technology.

In an embodiment of the disclosed technology, a strap for holding a musical instrument during playing the instrument, such as a guitar strap, has an attachment mechanism disposed thereon. The attachment mechanism is suitable for reversible attachment of one or more instrument playing accessories to the strap, to allow a musician wearing the musical instrument using the strap to easily find and access the instrument playing accessory(s).

According to an aspect of some embodiments of the teachings herein, there is provided a strap attachable to a musical instrument for enabling a musician to wear the musical instrument and for carrying at least one instrument playing accessory, the strap comprising:

an elongate main body portion, adapted to be placed on the body of the musician, the main body portion including an exterior surface adapted to be visible when said strap is worn by the musician, said at least one exterior layer including at least one attachment mechanism, for reversible attachment of the at least one instrument playing accessory, and at least one illumination element;

a pair of end elements, each disposed on one end of said main body portion, and including at least one instrument attachment mechanism for attaching said strap to the musical instrument; and at least one length adjustment mechanism, disposed between an end of said main body portion and one of said end elements, adapted to adjust a length of said strap.

Embodiments of the disclosed technology will become clearer in view of the following description of the drawings.

In the context of the specification and claims herein, the term "instrument playing accessory" relates to any device which aids a musician in playing a musical instrument, or in improving the musician's performance when playing the musical instrument. For example, an instrument playing accessory may be an aid for playing the instrument such as a pick or pick holder, capo, or slide for a guitar. An instrument playing accessory may also be an aid for performing using the instrument, such as a wireless transmitter for transmitting the instrument's music to a speaker system, a flask for enabling the musician to drink during the performance, and the like.

In the context of the specification and claims herein, the term "visible" relates to an element that can be seen by a person facing the element, without the need to change a direction or orientation of the element.

In the context of the specification and claims herein, the term "reversible attachment" of two elements relates to a condition in which the two elements are securely attached to one another, in some cases via an third, supporting element, but can be easily unattached without using any tools. Examples of reversible attachment include attachment by Velcro, by fasteners such as snaps, buttons in button holes, or hook and eye fasteners, and magnetic attachment.

In the context of the specification and claims herein, the term breathable material relates to any material allowing passage of gas therethrough, such as a mesh material, a woven material, or a material formed of natural fibers.

In the context of the specification and claims herein, the term "illumination generating element" relates to an element which does not receive illumination in order to provide illumination, but rather is, in itself, the source of illumination. For example, electrical lights, LEDs, and lamps, are all illumination generating element.

In the context of the specification and claims herein, the term "illumination reflecting element" relates to any element which must receive illumination, in some wavelength, in order to provide illumination. Examples of illumination reflecting elements include light reflectors, elements which provide illumination when illuminated with ultraviolet light such as white element, fluorescent elements, and luminescent elements. Further examples include when a material used for construction of an element responds to the blacklight on stage and appears to glow, or if the material is phosphorescent and glows by itself for a period of time following exposure to the light.

In the context of the specification and claims herein, the term "receptacle" relates to any element which houses another element therein, and wraps the housed element from at least a portion of at least three sides thereof.

Reference is now made to FIG. 1, which is a top view planar illustration of a strap for a musical instrument according to an embodiment of the disclosed technology.

As seen in FIG. 1, a strap 10 for a musical instrument, here shown as a guitar strap, includes an elongate main body portion 12, which is adapted to be placed against the body of the musician. In the illustrated embodiment, the main body portion 12 is a shoulder strap, adapted to be placed over the musician's shoulder while the musician wears the guitar.

Extending at opposing ends of the main body portion 12 are two end elements 14, each including at least one instrument attachment mechanism 16 for attachment of the strap to the musical instrument. In the illustrated embodiment, the instrument attachment mechanisms include holes which are reversibly attachable to strap buttons disclosed on a guitar (not shown). In some embodiments, strap locks (not shown) may also be installed on top of the strap buttons on the guitar to ensure secure fitting of the strap to the guitar.

Connector portions 18 connect the main body portion 12 of strap 10 to end elements 14. At least one of connector portions 18 further includes a length adjustment mechanism 20, such as a buckle for adjustment of the length of the connector portion 18 associated therewith, thereby to adjust the length of the strap 10. In the illustrated embodiment, length adjustment mechanisms are provided on both connector portions 18.

In some embodiments, at least one of the connector portions 18 further includes at least one buckle 22 for reversibly dividing the strap 10 into two portions, for example when storing the instrument and strap in a case. In some embodiments, one of the connector portions 18 further includes a cable clamp 24, adapted to holding a cable, extending from the instrument, in a fixed position relative to the instrument. For example, clamp 24 may keep a guitar output cable (not shown), which may be connected to an amplifier (not shown), in place and may prevent the cable from being pulled out of the instrument during a performance.

Mounted onto an exterior surface of the main body portion 12 are at least one attachment mechanism, illustrated in FIG. 1 as two such attachment mechanisms 26*a* and 26*b*. As explained in further detail hereinbelow, the attachment mechanisms 26*a*, 26*b* are adapted for reversible attachment thereto of at least one instrument playing accessory. The attachment mechanisms may be any suitable type of attachment mechanisms, including a strip of "hook" Velcro, a strip of "loop" Velcro, one or more fasteners, and/or one or more magnetic elements.

The attachment mechanisms 26*a*, 26*b* may be placed at any suitable location along the body portion, such that instrument playing accessories attached thereto are accessible to the musician. As such, the attachment mechanisms are often placed on a portion of the main body portion which extends along the musician's torso or lower back, and are thus easily accessible to the user.

The attachment mechanism(s) must be sufficiently strong for holding the accessories to the strap during a performance, even when the musician moves around or jumps. As such, in embodiments in which the attachment mechanism comprises Velcro, the strip of Velcro is preferably at least two inches wide.

Additionally, mounted onto the exterior surface of the main body portion 12 of the strap 10 is at least one illumination element 28, for creating light effects and improving the visual perception of the musician, for example during a performance. In some embodiments, the illumination element(s) 28 may include illumination generating elements, such as a strip of LED lights, or other illumination generating elements. In some embodiments, the illumination element(s) 28 may include illumination reflecting elements, such as reflector strips or fluorescent strips, which provide illumination when illuminated with one or more specific wavelengths. In some embodiments, the illumination element(s) may be arranged in a specific shape, such as, for example, as the logo of a band or musical group to which the musician belongs. Light shows are often incorporated into rock concerts, and it is visually pleasing if the guitar strap responds to the stage lights, blacklight, or if it glows in the dark when the stage is dark. In some embodiments, the illumination element(s) 28 are provided at areas of the main body portion 12 which are not easily accessible to a musician while wearing the instrument. For example, in a guitar strap, the illumination element(s) may be provided along the musician's shoulder and upper back.

The main body portion 12 of strap 10 is constructed to as to provide for even distribution of the weight of the instrument, and the instrument playing accessories, against the body of the musician, and for comfort during wearing the instrument using the strap. As such, the strap 10 has an adjustable length (as explained hereinabove) to enable the musician to adjust the strap in the optimal way for him or her. Additionally, the main body portion is preferably relatively wide, for example having a width of at least two inches, or at least half an inch wider than the widest attachment mechanism attached thereto.

In some embodiments, the main body portion 12 of the strap 10 may include a single layer, for example made of leather or synthetic fabric. In other embodiments, the main body portion may include multiple layers, such as an outer layer visible when the strap is worn by the musician and having mounted thereon the attachment mechanism(s) 26 and the illumination element(s) 28, a body engaging layer adapted to engage the body of the musician when the strap is worn, and a padding layer disposed between the outer layer and the body engaging layer. In some embodiments, the outer layer comprises a synthetic material, or leather. In some embodiments, the body engaging layer comprises a breathable material, such as a mesh fabric or a natural fabric. In some embodiments, the padding layer comprises foam or foam rubber. In some embodiments, the materials used for the layers of the main body portion are selected so as to minimize the weight of strap 10, or to evenly distribute the weight of the instrument and instrument playing accessories on the strap.

In some embodiments, at least one receptacle 30 for holding an additional instrument playing accessory is attached to strap 10. For example, in the illustrated embodiment, such a receptacle 30 is attached to connector portion 18, and is adapted for holding a flashlight, as described hereinbelow with reference to FIGS. 4A to 4D.

Figure 2A:
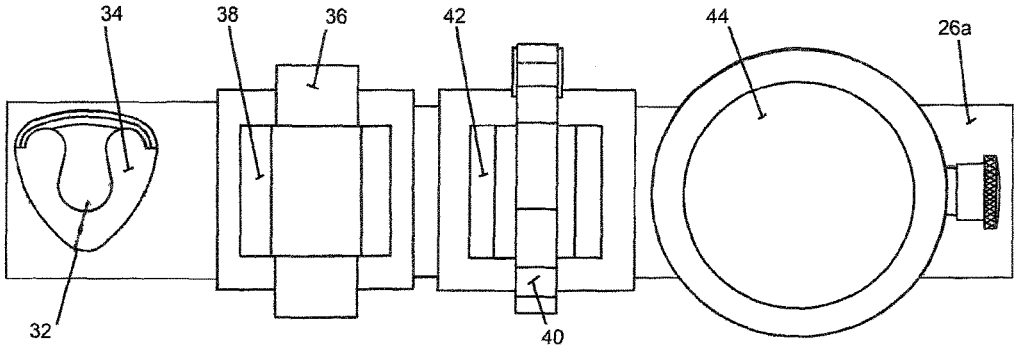
FIGS. 2A and 2B are top view planar illustrations of attachment mechanisms of the strap of FIG. 1, having attached thereto a plurality of instrument playing accessories.
Figure 2B:
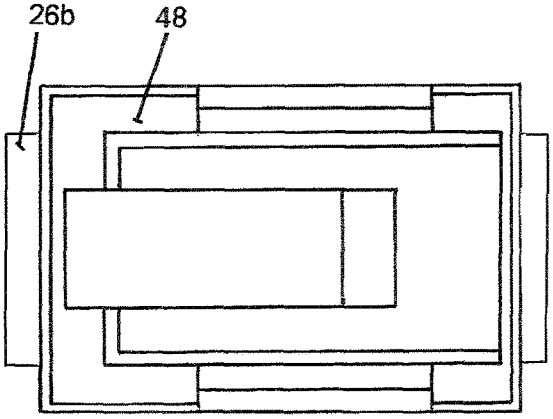

Reference is now made to FIGS. 2A and 2B, which are top view planar illustrations of attachment mechanisms 26*a* and 26*b* of the strap 10, having attached thereto a plurality of instrument playing accessories suitable for use with a guitar.

As seen in FIGS. 2A and 2B, instrument playing accessories suitable for use with a guitar include guitar picks 32 disposed within a pick holder 34, a slide 36 disposed within a slide holder 38, a capo 40 disposed within a capo holder 42, and a flask 44, all of which are illustrated as being disposed on the first Velcro strip 26*a*, and a wireless transmitter typically disposed within a wireless transmitter holder 48 on the second Velcro strip 26*b*. Each of the instrument playing accessories illustrated in FIGS. 2A and 2B is described in further detail hereinbelow with respect to FIGS. 3A-3D.

The types of instrument playing accessories disposed on the strap 10, and the arrangement of the various instrument playing accessories on the strap 10, or on the Velcro strips 26, may be any accessories and/or arrangement convenient for the musician, and are not limited to the examples illustrated in the Figures.

Figure 3A:
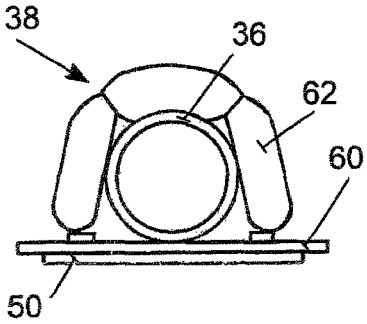
FIGS. 3A and 3B are side view planar illustrations of two of the instrument playing accessories of FIG. 2A.
Figure 3B:
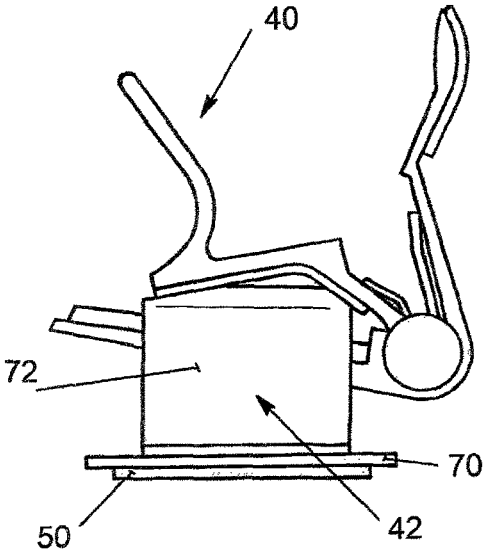
Figure 3C:
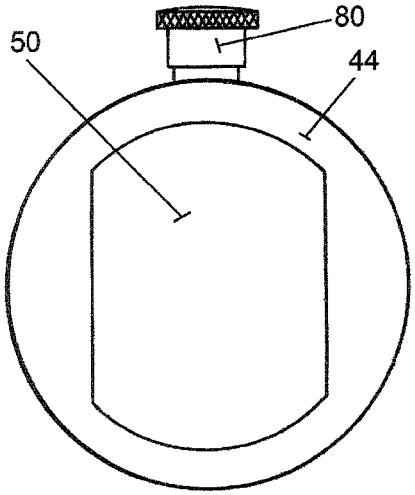
FIG. 3C is a bottom view planar illustration of one of the instrument playing accessories of FIG. 2A.
Figure 3D:
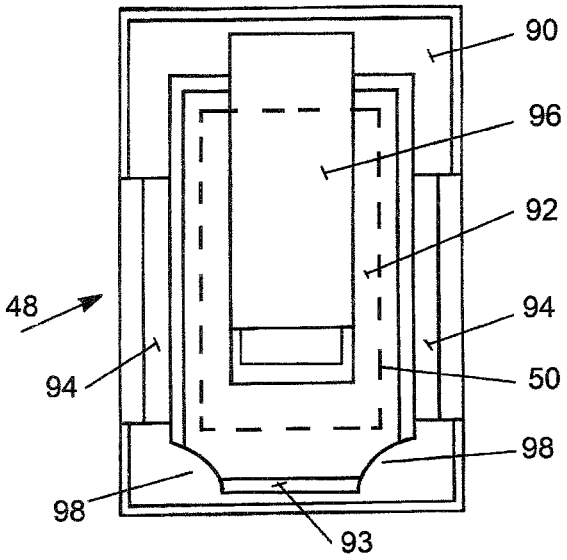
FIG. 3D is a top view planar illustration of one of the instrument playing accessories of FIG. 2B.

Reference is now additionally made to FIGS. 3A and 3B, which are side view planar illustrations of slide 36 and slide holder 38, and of capo 40 and capo holder 42, of FIG. 2A, to FIG. 3C which is a bottom view planar illustration of flask 44 of FIG. 2A, and to FIG. 3D, which is a top view planar illustration of wireless transmitter and wireless transmitter holder 48 of FIG. 2B.

As seen in FIGS. 3A-3D, each of the instrument playing accessories or holders associated therewith includes a corresponding attachment mechanism 50, for reversible attachment of the accessory and holder to the attachment mechanisms 26.

As such, in embodiments in which attachment mechanisms 26 comprise a hooks Velcro strip, the corresponding attachment mechanisms 50 comprise a loops Velcro strip. Conversely, in embodiments in which attachment mechanisms 26 comprise a loops Velcro strip, the corresponding attachment mechanisms 50 comprise a hooks Velcro strip. In other embodiments, in which the attachment mechanisms 26 comprise fasteners, the corresponding attachment mechanisms comprise corresponding fasteners. For example, if attachment mechanisms 26 comprise a hook fastener, the corresponding attachment mechanism 50 comprise eye fasteners. As another example, if attachment mechanisms 26 comprise a button, the corresponding attachment mechanism 50 comprise button-hole or button-loop. In other embodiments, in which the attachment mechanisms 26 comprise magnetic elements, the corresponding attachment mechanisms 50 comprise corresponding metallic or magnetic elements attachable to the magnetic elements on the strap.

Turning specifically to FIG. 3A, it is seen that the slide holder 38 includes a base 60 having mounted on a bottom surface thereof the corresponding attachment mechanism 50 for attachment to the attachment mechanism 26 of strap 10, and on a top surface thereof a generally arched receptacle 62 adapted for securely housing the slide 36. The receptacle 62 may be elastic, or padded, in order to facilitate secure holding of the slide 36, as known in the art.

As shown in FIG. 3B, the capo holder 42 comprises a base 70 on which a corresponding fastening mechanism 50 is mounted on its lower surface for attachment to the fastening mechanism 26 of the strap, 10 and on its upper surface an arc-shaped receptical 72 similar to the arc 62 of the slide holder 38, adapted for insertion inside the clamp cap 40. The clamp of the capo is inserted from the side and fixed on the arc 72 in any position just as it covers the neck of the guitar. In some cases, the holders of slide and capo can be interchangeable.

In FIG. 3C it is seen that the flask 44 has the corresponding attachment mechanism 50 attached directly to the bottom surface thereof. The flask 44 may be any suitable flask including an openable cover 80 for insertion into the flask, and for drinking from the flask, of any drink which would be helpful to the musician, such as water or an energy drink.

Turning to FIG. 3D, it is seen that wireless transmitter holder 48 includes a base 90 and a corresponding fastening mechanism 50 (shown in dotted lines) mounted on its lower surface. The holder 48 further includes a front portion 92 connected to the base 90 by resilient side walls 94 and a lower portion 93 connected to the front portion 92 and the base 90. The wireless transmitter is disposed between the front portion 92 and the base 90 with a yoke 96 of the transmitter extending above the front part 92 and secured to it by the hook-and-loop fastener. The elastic side walls 94 allow the transmitters of different sizes to be mounted in the holder 48. An output cable of the instrument (not shown), which is connected to the wireless transmitter, may extend through openings 98 adjacent bottom portion 93.

It is appreciated that though some instrument playing accessories are illustrated as being housed in a holder which holder is reversibly attached to the strap 10, those accessories may also be directly reversibly attached to the strap 10. Similarly, accessories shown as being directly reversibly attached to the strap 10 may also be enclosed in a holder which is reversibly attached to the strap 10.

Reference is now made to FIGS. 4A, 4B, 4C, and 4D, which are, respectively, a top view illustration of a flashlight clamp, a side view illustration of the flashlight clamp having a flashlight disposed therein, a side view illustration of a holder for the flashlight clamp, and a top view illustration of the holder for the flashlight clamp.

Figure 4A:
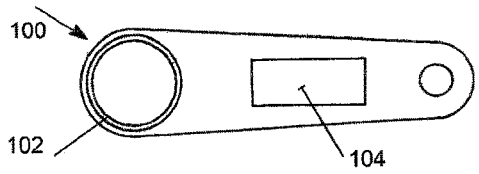
FIGS. 4A, 4B, 4C, and 4D are, respectively, a top view illustration of a flashlight clamp, a side view illustration of the flashlight clamp having a flashlight disposed therein, a side view illustration of a holder for the flashlight clamp, and a side top illustration of the holder for the flashlight clamp.
Figure 4B:
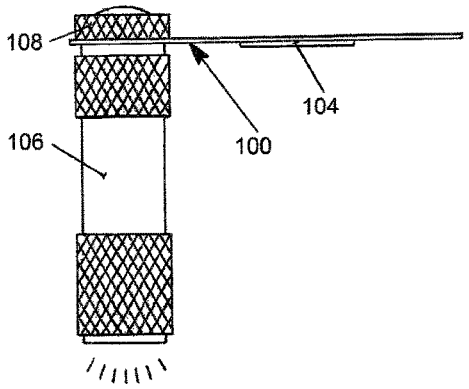

As seen in FIGS. 4A and 4B, a flashlight clamp 100 includes a bore 102 for passage of a flashlight therethrough, and an attachment mechanism 104 disposed on a surface thereof. A flashlight 106 may extend through the bore 102. The clamp 100 may be fixed in the flashlight 106 by a battery cover 108 in the flashlight.

Figure 4D:
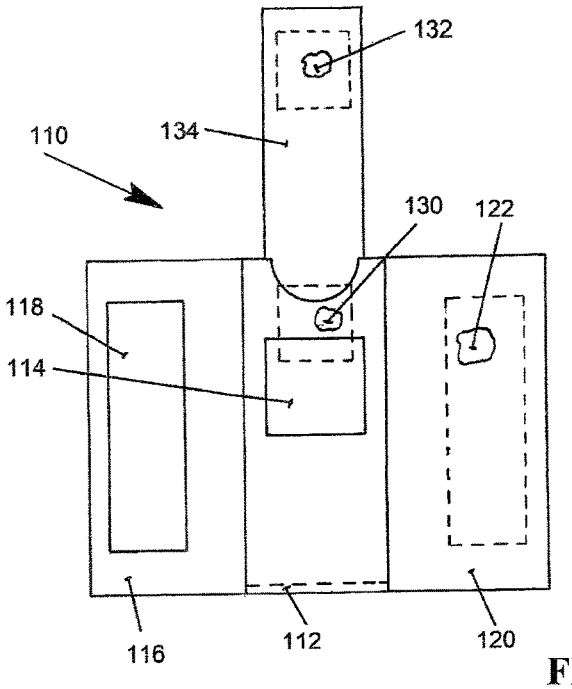
Figure 4C:
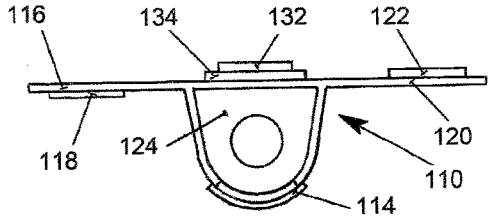

FIGS. 4C and 4D show a flashlight holder 110. The holder consists of a flashlight compartment 124, a first wing 116, comprising a Velcro strip 118, a second wing 120, including a Velcro strip 122, a bottom 112, and a yoke 134 with a Velcro strip 132. A flashlight 106 with a clip 100 is inserted into the flashlight compartment 124 and fixed by the hook and loop Velcro arrangements 104 and 114.

The flashlight holder 110 is attached to the strap 10 in the following manner: the clamp 134 is threaded into the buckle of the main body 12 of the strap and fixed by the hook and loop Velcro arrangements 130 and 132; the wings 116 and 120 wrap the connection portion 18 and are secured by the hooks and loop Velcro arrangements 118 and 122, which better fixes the holder 110 to the belt 10. If necessary, a guitar output cable (not shown) can be held simultaneously by wings 116 and 120, which can be connected to an amplifier (not shown).

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A strap attachable to a musical instrument for enabling a musician to wear the musical instrument and for carrying at least one instrument playing accessory, the strap comprising:

an elongate main body portion, adapted to be placed on the body of the musician, the main body portion including an exterior surface adapted to be visible when said strap is worn by the musician, said at least one exterior layer including at least one attachment mechanism, for reversible attachment of the at least one instrument playing accessory, and at least one illumination element;

a pair of end elements, each disposed on one end of said main body portion, and including at least one instrument attachment mechanism for attaching said strap to the musical instrument; and at least one length adjustment mechanism, disposed between an end of said main body portion and one of said end elements, adapted to adjust a length of said strap.

2. The strap of claim 1, wherein said elongate main body portion includes:

a body engaging layer adapted to engage the body of the musician when the strap is placed on the body of the musician;

an exterior layer including said exterior surface; and a padding layer disposed between said body engaging layer and said exterior layer.

3. The strap of claim 2, wherein said body engaging layer comprises of a breathable material, said exterior layer comprises a synthetic fabric, and said padding layer comprises foam or foam rubber.

4. The strap of claim 1, wherein said strap is formed of at least one of leather, synthetic fabric, and silicone.

5. The strap of claim 1, wherein said at least one illumination element comprises an illumination generating element.

6. The strap of claim 1, wherein said at least one illumination element comprises an illumination reflecting element.

7. The strap of claim 1, further comprising at least one receptacle adapted to house an additional instrument playing accessory.

8. The strap of claim 1, wherein said at least one attachment mechanism comprises at least one of a hook portion of a Velcro strip, a loop portion of a Velcro strip, at least one fastener, and at least one magnetic element.

9. A system for carrying a musical instrument, the system comprising:

a strap, reversibly attachable to the musical instrument, the strap comprising:

an elongate main body portion, adapted to be placed on the body of the musician, the main body portion including an exterior surface adapted to be visible when said musical instrument is worn by the musician, said at least one exterior layer including at least one attachment mechanism and at least one illumination element;

a pair of end elements, each disposed on one end of said main body portion, and including at least one instrument attachment mechanism for reversibly attaching said strap to the musical instrument; and at least one length adjustment mechanism, disposed between an end of said main body portion and one of said end elements, adapted to adjust a length of said strap; and at least one instrument playing accessory associated with at least one corresponding attachment mechanism, reversibly attachable to said at least one attachment mechanism, thereby to reversibly attach said at least one instrument playing accessory to said strap.

10. The system of claim 9, wherein said at least one corresponding attachment mechanism is disposed on at least one receptacle for said at least one instrument playing accessory, said at least one receptacle being reversibly attachable to said at least one attachment mechanism.

11. The system of claim 10, wherein said musical instrument comprises a guitar, and said at least one instrument playing accessory comprises at least one of a capo, a slide, a guitar pick holder, a guitar pick, and a flask.

12. The system of claim 9, wherein said elongate main body portion of said strap includes:

a body engaging layer adapted to engage the body of the musician when the strap is placed on the body of the musician;

an exterior layer including said exterior surface; and a padding layer disposed between said body engaging layer and said exterior layer.

13. The system of claim 12, wherein said body engaging layer comprises of a breathable material, said exterior layer comprises a synthetic fabric, and said padding layer comprises foam or foam rubber.

14. The system of claim 9, wherein said strap is formed of at least one of leather, synthetic fabric, and silicone.

15. The system of claim 9, wherein said at least one illumination element comprises an illumination generating element.

16. The system of claim 9, wherein said at least one illumination element comprises an illumination reflecting element.

17. The system of claim 9, further comprising at least one receptacle adapted to house an additional instrument playing accessory.

18. The system of claim 17, wherein said additional instrument playing accessory comprises a flashlight.

19. The strap of claim 1, wherein at least one of the following:

said at least one attachment mechanism comprises a hook portion of a Velcro strip and said at least one corresponding attachment mechanism comprises a loop portion of a Velcro strip;

said at least one attachment mechanism comprises a loop portion of a Velcro strip and said at least one corresponding attachment mechanism comprises a hook portion of a Velcro strip;

said at least one attachment mechanism comprises at least one fastener and said at least one corresponding attachment mechanism comprises a corresponding fastener; and said at least one attachment mechanism comprises at least one magnetic element and said at least one corresponding attachment mechanism comprises a corresponding magnetic or metallic element.

* * * * *